US007338395B1

(12) United States Patent
Hurley

(10) Patent No.: US 7,338,395 B1
(45) Date of Patent: Mar. 4, 2008

(54) DEVICE TO TRAIN A PITCHER

(76) Inventor: Ron Hurley, 10240 Huntington Forest Blvd. East, Jacksonville, FL (US) 32257

( * ) Notice: Subject to any disclaimer, the term of this patent is extended or adjusted under 35 U.S.C. 154(b) by 142 days.

(21) Appl. No.: 11/406,732

(22) Filed: Apr. 19, 2006

(51) Int. Cl.
*A63B 69/00* (2006.01)

(52) U.S. Cl. ..... 473/454

(58) Field of Classification Search ..... 473/454, 473/497, 415; D21/780; 33/756, 759, 1 G
See application file for complete search history.

(56) References Cited

U.S. PATENT DOCUMENTS

| | | | | | |
|---|---|---|---|---|---|
| 2,156,469 | A * | 5/1939 | Boltz | 473/497 | |
| 2,189,428 | A * | 2/1940 | Love | 473/497 | |
| 3,558,134 | A * | 1/1971 | Hoitsma | 473/428 | |
| 3,668,781 | A * | 6/1972 | Teter | 33/1 H | |
| 4,057,248 | A * | 11/1977 | Stoecker | 473/451 | |
| 4,160,324 | A * | 7/1979 | Dunn | 33/759 | |
| 4,826,164 | A | 5/1989 | Butcher | | |
| 4,930,774 | A | 6/1990 | Butcher | | |
| 4,978,121 | A * | 12/1990 | Larkey | 473/454 | |
| 5,107,595 | A * | 4/1992 | Stay et al. | 33/1 G | |
| 5,213,323 | A | 5/1993 | Novinsky | | |
| 5,354,050 | A | 10/1994 | McCarthy | | |
| 5,407,193 | A | 4/1995 | McGinley | | |
| 5,472,187 | A | 12/1995 | Kempf | | |
| 5,704,855 | A | 1/1998 | Kellogg, Jr. | | |
| 5,743,808 | A | 4/1998 | Barth | | |
| 6,139,450 | A | 10/2000 | Rivers | | |
| 6,430,819 | B1 * | 8/2002 | Aldstadt et al. | 33/1 G | |
| 6,500,078 | B1 | 12/2002 | Williams et al. | | |
| 6,651,497 | B2 | 11/2003 | Imatoh | | |
| 6,843,739 | B2 * | 1/2005 | Putnam | 473/497 | |
| 6,893,365 | B2 * | 5/2005 | Rathbun et al. | 473/500 | |
| 6,945,883 | B1 | 9/2005 | Williams et al. | | |

* cited by examiner

*Primary Examiner*—Eugene Kim
*Assistant Examiner*—M Chambers
(74) *Attorney, Agent, or Firm*—Lawrence J. Gibney, Jr.

(57) ABSTRACT

This is a device for training a pitcher in establishing his or her direct line to home plate during initial set-up of delivery of a pitch to home plate. Once the direct line to home plate has been established the training device then teaches the proper body mechanics as the pitch is delivered in the relationship of the follow through position. The device also teaches the pitcher of throwing a pitch to a specific area of home plate.

1 Claim, 5 Drawing Sheets

DEVICE TO TRAIN A PITCHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to instructing or teaching a pitcher in the proper body mechanics to throw a baseball without limitations in a direct line towards home plate and to a specific area of home plate.

B. Prior Art

There are many prior art references related to baseball and in particular teaching the young pitcher how to develop good body mechanics. Representative examples of them can be found in the following patents: Williams, U.S. Pat. No. 6,945,883, Imatoh U.S. Pat. No. 6,651,497, Williams U.S. Pat. No. 6,500,078, and Rivers U.S. Pat. No. 6,139,450.

The Williams patents teach a device that will help the pitcher achieve proper foot alignment as the pitcher delivers the pitch. These patents do not attempt to teach the pitcher his or her direct line to home plate or to throw toward any specific area of the plate. For instance, the Williams devices simply instruct the pitcher on the proper alignment of the pitcher's body after the pitch. The current device achieves the same result but improves upon the Williams patents.

Imatoh teaches a device to properly position the pitcher's arm during delivery of a pitch. It does not teach the proper alignment of the lead leg. Rivers details a system for training a baseball pitcher to properly position a drive leg at the middle of the delivery while throwing a ball.

All these particular devices teach or attempt to instruct a pitcher how to throw a baseball correctly towards home plate with limitations. However, pitchers use a variety of positions as to his or her foot placement on or around the pitching rubber without limitations. Once their foot placement has been determined the device in this case teaches the pitcher the appropriate alignment of the legs to give them their direct line during the pitching motion to home plate as well as directing the pitch towards a specific area of the plate.

BRIEF SUMMARY OF THE INVENTION

This is a device to instruct or train a pitcher in the proper body mechanics in terms of throwing a baseball in his or her established direct line towards home plate. Proper body mechanics are essential to correct repeated delivery of a pitch, control, velocity, and to prevent injury.

It is comprised, in part, of a "pitching rubber" or pitching plate, which can be made from a variety of materials but probably wood. The pitching plate is commonly used in baseball and is the place where the pitcher places his or her foot prior to the pitch.

Another part of the device is a rope, which extends from and is connected to the pitching plate and connects to a specific part of home plate. The rope should be long enough to simulate the distance from the pitching plate to home plate. When the device is used the rope will be taut between the pitching plate and home plate.

Home plate is a common feature that is found in baseball. Both the pitching plate and home plate are made with standard dimensions. Home plate like the pitching plate can be made of a variety of materials although wood is probably the likely choice of material.

On both the pitching plate and home plate will be a series of connection pieces where the respective ends of the rope can be attached. The means of connection for the respective ends of the rope on the pitching plate and home plate is probably a series of eyebolts. A clip on both ends of the rope is used to connect the respective ends of the rope to both the pitching plate and home plate.

A means to secure both the pitching plate and home plate into the ground will also be included and will probably consist of a series of bolts or screws, which extend from the underside of the pitching plate and home plate, respectively. The purpose of the securing means is simply to ensure that the pitching plate and/or home plate do not shift. This device is intended to be used on a flat ground surface. This is a tool to train a pitcher on the correct position of his or her legs as the pitch is delivered to the plate.

In operation the pitcher can adjust the rope to teach him or her the appropriate alignment of his legs when directing a pitch towards a particular area of home plate such as the inside or outside corner of home plate.

The pitcher places one leg or both legs at any position on the pitching plate to begin his delivery of the ball to home plate. This motion is typically called their wind up or stretch position. Once the delivery has begun the rope should be attached to the eye bolt closest to the instep of the driving leg's foot (foot on top of or against the pitching plate). This will determine the pitcher's direct line to home plate. As the pitcher propels his leading leg towards home plate it should land on the rope that is connected between the pitching plate and home plate.

It is an object of this particular device to teach a pitcher the proper body mechanics when throwing a baseball. This device can be used with all types of pitching sports, including baseball and softball.

DETAILED DESCRIPTION OF THE EMBODIMENTS

Figure 1:
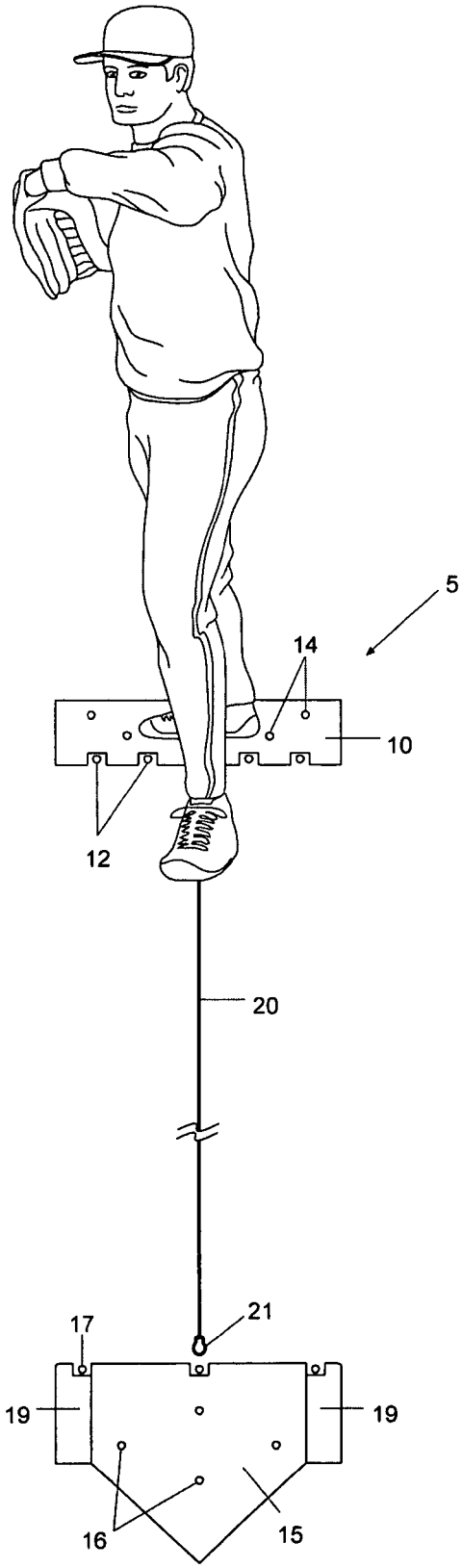
FIG. 1 is a view of the device demonstrating proper leg position after the pitch.

This is a device 5 to train a pitcher how to throw a baseball relative to the pitcher's direct line to the home plate. Specifically it will teach the pitcher the correct position of the leading leg after delivery of the pitch. In order to avoid injury and maximize the velocity and control, it is important that the pitcher learns the proper body mechanics in throwing a pitch. If the pitcher does not properly align his leading leg, the efficiency of the pitch and/or control of the pitch will be effected. Additionally injury to the player may also result from improper body mechanics.

For instance, when a pitcher throws a baseball, the pitcher stands on a portion of a pitching plate 10 that is secured to the ground by a securing means 14. The means to secure this device to the ground will consist of either a long set of screws or a long set of bolts. The purpose of the securing means 14 is to prevent the pitching plate from shifting during use.

On the front edge of the pitching plate will be a series of notches or cavities into which a means to connect 12 a rope is provided. The means to connect 12 may be eyebolts or another type of connective means. The purpose of the means of connection at the pitching plate is so that a rope, which is secured to the pitching plate 10 at one end and to home plate at the other, remains in place and is properly aligned.

A rope 20 with a means to connect 21 is placed in one of the eyebolts 12 at the pitching plate 10, and the other end of the rope is connected—in a straight line—to a part of home plate 15. Home plate 15, like the pitching plate 10 is also provided with a series of cavities or notches in which the means to connect home plate 17 is provided. Like the means to connect for the pitching plate, the means to connect home plate is to insure a straight line during use of the device and is also probably eyebolts.

Home plate is also secured to the ground with a similar securing means 16 such as screws or bolts. The other end of the rope is again connected to a means to connect the rope 21, which will consist of either eyebolts or clasps on the ends of the rope 20. Several notches are provided for possible pitch positions.

When the baseball is thrown towards home plate, the pitcher steps from the pitching plate with his driving foot firmly against the pitching plate. As the pitcher leaves and moves towards home plate with the baseball, the front or leading foot should land squarely on the rope, which is in a position in front of the pitcher, after delivery of the pitch. FIG. 1

Figure 2:
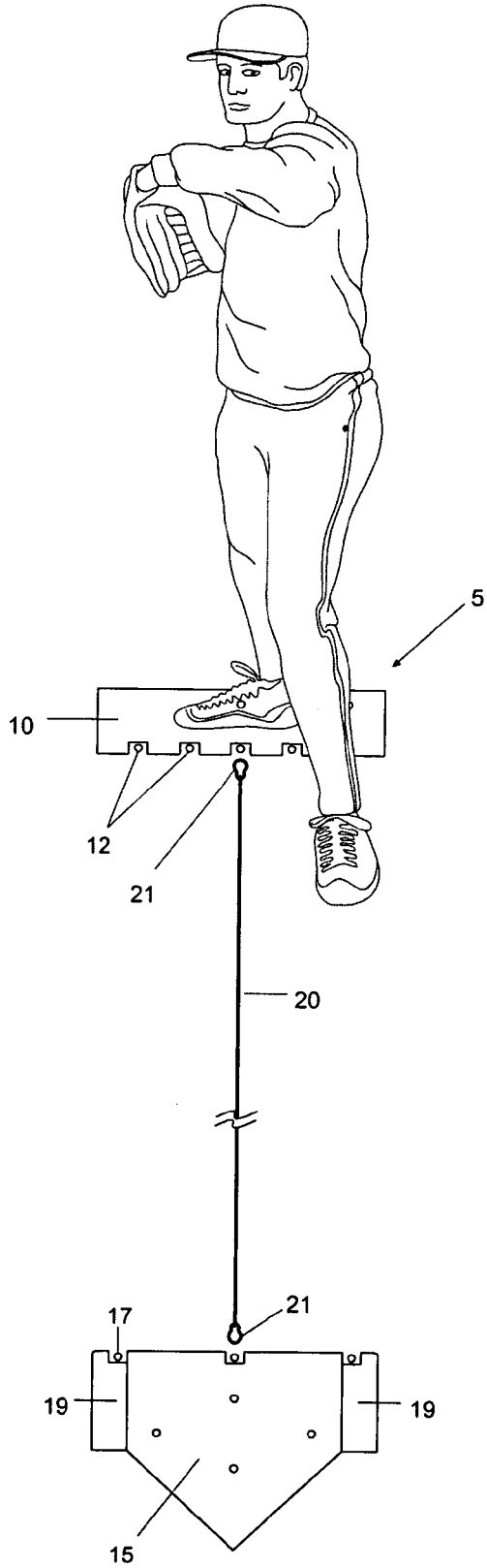
FIG. 2 is a view of the device demonstrating improper pitching mechanics, specifically too open.
Figure 3:
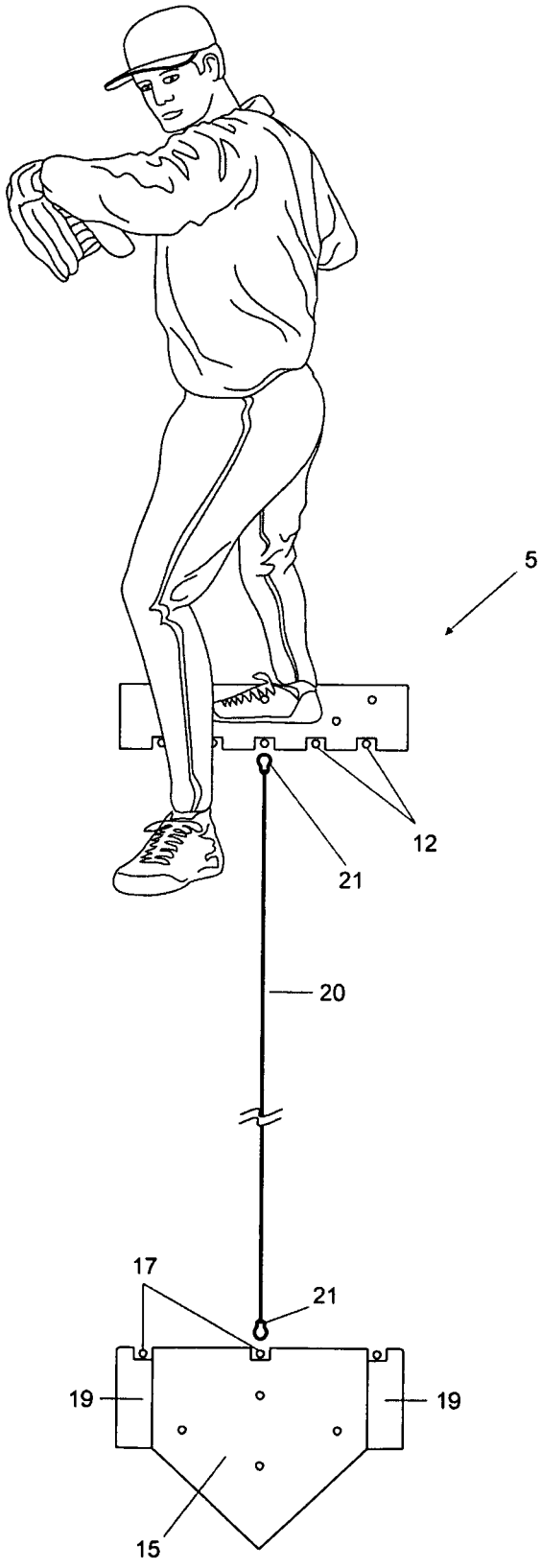
FIG. 3 is a view of the device demonstrating improper pitching mechanics, specifically too closed.

In the overhead, or under hand for softball pitch if the pitcher's leading foot does not land on the rope, the pitch is not as effective or the velocity and/or control of the pitch is not maximized. This position of the pitcher's foot on the rope will maximize the velocity of the pitch as well as the control of the pitch. It will also prevent injury to the pitcher. Injury occurs when the pitcher does not fully open his pitching or opens the pitching rotation too much such as depicted in FIGS. 2 and 3.

This is a training tool, which is placed on the flat ground. The purpose of placing it on flat ground is not to maximize the velocity but instead to teach the young pitcher the proper body mechanics. Several notches are placed on the front of home plate so that the pitcher learns the proper foot position for an inside pitch, a down-the-middle-of-the plate pitch as well as an outside pitch. The outer sections of home plate 19, which are connected to home plate indicates the outer edges of home plate. This is needed to teach the pitcher the proper positioning for an inside pitch and an outside pitch (depending on the position of the batter, right handed or left handed). Assuming that the pitch is within the proper height parameters and as long as the pitch crosses over any portion of home plate near the corners of home plate, it is a strike.

Figure 4:
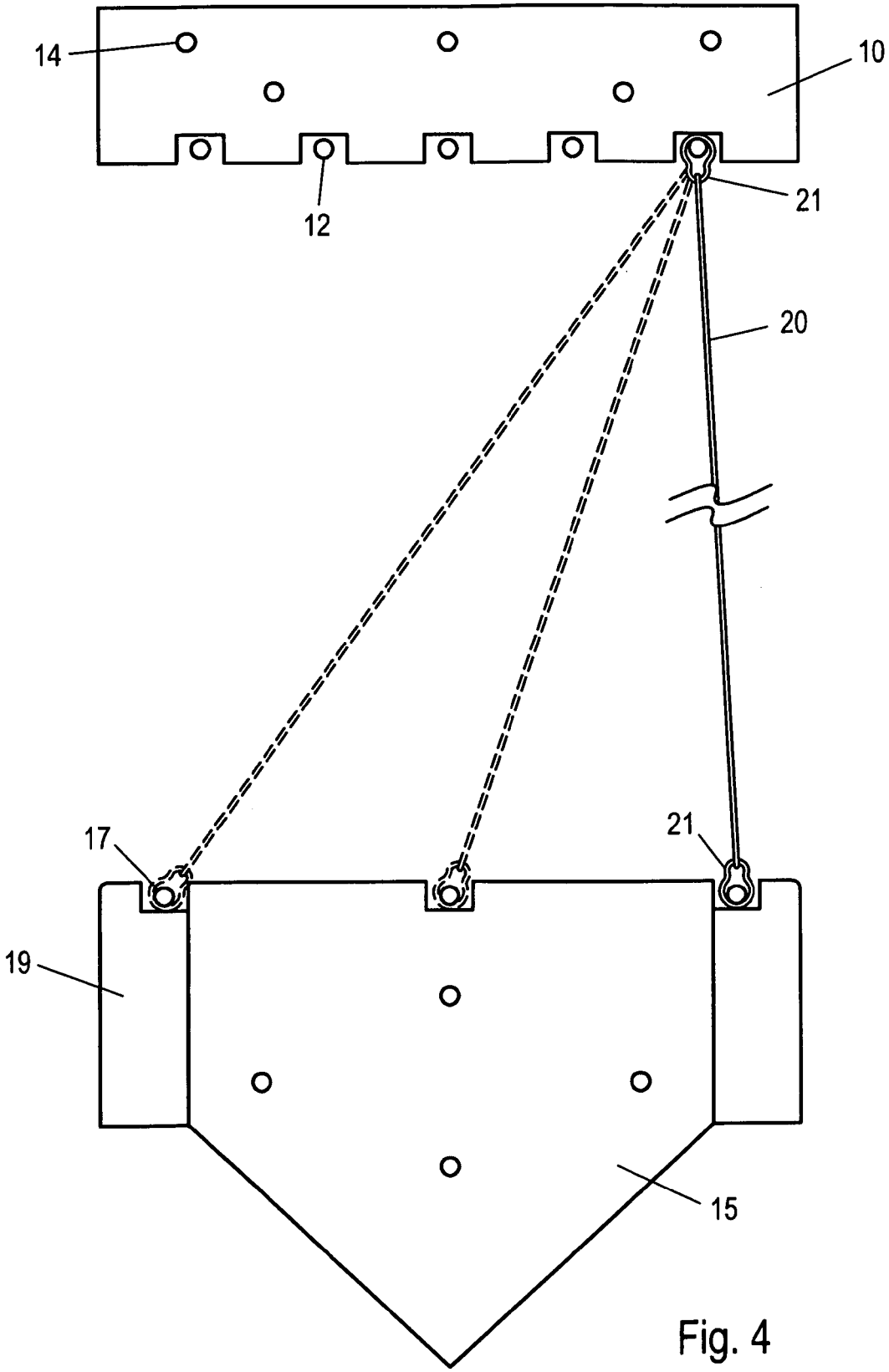
FIG. 4 is a view of the pitching plate, home plate and rope and the possible directional changes made by a pitcher to direct a pitch towards a particular area of home plate.
Figure 5:
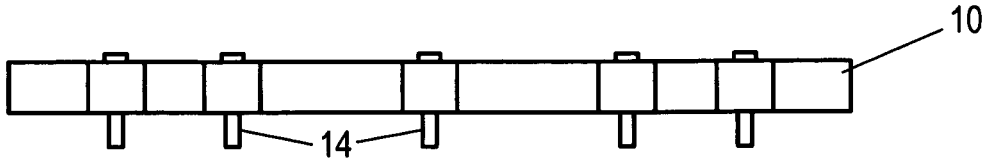
FIG. 5 is a front view of the pitching plate.
Figure 6:
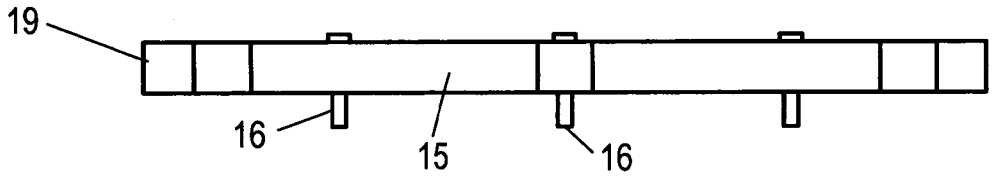
FIG. 6 is a front view of home plate.

Because the pitcher can select the position for a predetermined pitch, the pitcher—through repetitions—can learn the proper foot position for each particular pitch. The slight difference in position with the leading leg will determine the location of a pitch over the plate. Different connection points of the pitching plate and home plate allow the pitcher to learn the various positions depending on his or her style of pitching such as depicted in FIG. 4.

Because every pitcher is slightly different in the position on the pitching plate, various foot positions are contemplated for the pitching plate as well.

As stated previously this device can be used to train a pitcher to throw an overhead pitch or an underhand pitch.

The invention claimed is:

1. A method to train a pitcher which is comprised of the following steps:

a) obtaining a training device comprised of:

1) a pitching plate; wherein the pitching plate is planar; wherein the pitching plate is of a predetermined thickness; wherein a means to secure the pitching plate to the ground is provided; wherein a means to connect a rope to the pitching plate is provided; wherein a plurality of notches are provided on the pitching plate; wherein a means to connect one end of a rope is provided in each of the notches in the pitching plate;

2) a rope; wherein a rope has a means of connection on the first and second ends of the rope; wherein the first end of said rope is connected to the pitching plate; wherein the second end of said rope is connected to home plate; wherein a single rope is used;

3) a home plate; wherein home plate is of a predetermined thickness; wherein home plate is planar; wherein a means to secure home plate to the ground is provided; wherein a series of notches are provided on front surface of the home plate; wherein a means to connect one end of a rope is provided in each of the notches in home plate; wherein a means to connect the rope to one end of home plate is provided;

b) securing the pitching plate to the ground;

c) selecting the notch to be used;

d) connecting the first end of the rope to the pitching plate;

e) placing the home plate the appropriate distance from the pitching plate;

f) securing the home plate to the ground;

g) connecting the second end of the rope to the home plate;

h) insuring that the rope is straight between the pitching plate and the home plate;

i) pitching a ball from the pitching plate to the home plate so that the pitcher's foot lands on the rope that has been placed between the pitching plate and the home plate.

* * * * *